US007252452B2

(12) United States Patent
Africa et al.

(10) Patent No.: US 7,252,452 B2
(45) Date of Patent: Aug. 7, 2007

(54) BINDER WITH FRONT POCKET

(75) Inventors: Thomas J. Africa, Lebanon, OH (US); Erik N. Sabin, New Vienna, OH (US)

(73) Assignee: MeadWestvaco Corporation, Glen Allen, VA (US)

( * ) Notice: Subject to any disclaimer, the term of this patent is extended or adjusted under 35 U.S.C. 154(b) by 293 days.

(21) Appl. No.: 10/462,190

(22) Filed: Jun. 16, 2003

(65) Prior Publication Data

US 2004/0253046 A1 Dec. 16, 2004

(51) Int. Cl.
*B42F 13/00* (2006.01)

(52) U.S. Cl. ..... 402/73; 281/15.1; 281/29; 281/31; 402/4; 402/57; 402/74; 402/76; 402/78; 402/79; 402/80 R; 19/26; 206/232; 206/312; 206/805

(58) Field of Classification Search ..... 402/4, 402/57, 73, 79, 80 R, 74, 75, 76, 78; 281/15.1, 281/29, 31; D19/26; 206/232, 312, 805; 229/67.4, 77; 24/67 R
See application file for complete search history.

(56) References Cited

U.S. PATENT DOCUMENTS

| | | | | | |
|---|---|---|---|---|---|
| 1,023,834 | A | * | 4/1912 | Gareis | 281/31 |
| 1,495,953 | A | | 5/1924 | Dick | |
| 2,161,015 | A | * | 6/1939 | Buxton | 281/17 |
| D182,059 | S | * | 2/1958 | Chase | D3/233 |
| 3,620,440 | A | * | 11/1971 | Humphrey | 229/72 |
| D223,644 | S | * | 5/1972 | Croon | D3/247 |
| 4,296,945 | A | * | 10/1981 | Pavlik | 281/51 |
| 4,420,112 | A | * | 12/1983 | Cline | 229/72 |
| 4,848,798 | A | * | 7/1989 | Moor | 281/31 |
| 5,030,027 | A | * | 7/1991 | Bachrach et al. | 402/4 |
| 5,340,156 | A | * | 8/1994 | Bianco | 281/37 |
| 5,378,022 | A | * | 1/1995 | French et al. | 281/31 |
| 5,407,230 | A | * | 4/1995 | Brink et al. | 281/15.1 |
| 5,676,482 | A | * | 10/1997 | Hawkins | 402/79 |
| 5,711,627 | A | * | 1/1998 | Chapman | 402/3 |
| 5,876,143 | A | | 3/1999 | Ong | |
| 5,947,279 | A | * | 9/1999 | Lee et al. | 206/232 |
| 5,997,207 | A | | 12/1999 | Robinson | |
| 6,045,161 | A | | 4/2000 | Ashcraft et al. | |
| D424,615 | S | | 5/2000 | Wyant | |
| D432,172 | S | * | 10/2000 | Moor | D19/99 |
| 6,367,842 | B1 | * | 4/2002 | Wien et al. | 281/37 |
| 6,371,679 | B1 | * | 4/2002 | Peleman | 402/73 |
| 6,394,497 | B1 | * | 5/2002 | Ho | 281/29 |
| 6,431,779 | B1 | | 8/2002 | Moor et al. | |

(Continued)

FOREIGN PATENT DOCUMENTS

DE 20005566 U1 * 5/2000

*Primary Examiner*—Monica Carter
*Assistant Examiner*—Mark Henderson
(74) *Attorney, Agent, or Firm*—Thompson Hine LLP

(57) ABSTRACT

A binder including a binder body including a front cover and a rear cover directly or indirectly pivotally coupled together, and a panel located on an outer surface of the binder body to thereby form a pocket between the panel and the binder body. The panel has a free edge located adjacent to a mouth of the pocket. The mouth faces an outer edge of the binder body, and the free edge of the panel is located a variable distance from the outer edge of the binder body along the length of the free edge such that the pocket has a variable width.

30 Claims, 4 Drawing Sheets

U.S. PATENT DOCUMENTS 6,558,062 B1 * 5/2003 Wyant et al. ..... 402/73
D486,518 S * 2/2004 Africa et al. ..... D19/27
6,739,784 B1 * 5/2004 Tims et al. ..... 402/73
6,764,242 B1 * 7/2004 Karten et al. ..... 402/73
6,773,195 B2 * 8/2004 Tims ..... 402/73
D499,761 S * 12/2004 Walley et al. ..... D19/26
D513,279 S * 12/2005 Hough et al. ..... D19/86
D518,105 S * 3/2006 Hough et al. ..... D19/86
D521,072 S * 5/2006 Hough et al. ..... D19/90
2002/0051677 A1 5/2002 Moor et al.
2003/0210949 A1 * 11/2003 Tims ..... 402/73

* cited by examiner

BINDER WITH FRONT POCKET

The present invention is directed to a binder with a pocket located on or coupled to an outer or front surface thereof.

BACKGROUND

Binders, folders, portfolios, notebooks and the like are often used by businesses, students, etc. in order to store loose items and provide a convenient carrying device. However, many existing binders, folders, notebooks or portfolios have limited storage space and may in particular lack storage space on an outer surface of the binder.

SUMMARY

The present invention is a binder with a pocket located on an outer surface thereof. In particular, in one embodiment, the pocket may have a variable width, and in another embodiment at least part of the closure mechanism of the binder may be located on the pocket. In one embodiment, the invention is a binder including a binder body including a front cover and a rear cover directly or indirectly pivotally coupled together, and a panel located on an outer surface of the binder body to thereby form a pocket between the panel and the binder body. The panel has a free edge located adjacent to a mouth of the pocket. The mouth faces an outer edge of the binder body, and the free edge of the panel is located a variable distance from the outer edge of the binder body along the length of the free edge such that the pocket has a variable width.

In another embodiment, the invention is a binder including a binder body including a front cover and a rear cover directly or indirectly pivotally coupled together. The binder body is movable between a closed position, wherein the front and rear covers are generally parallel and facing each other, and an open position wherein the front and rear covers are not generally parallel and facing each other. The binder includes a panel located on an outer surface of the binder body to thereby form a pocket between the panel and the binder body. The binder further includes a closure mechanism for retaining the binder in the closed position, at least part of the closure mechanism being located on the panel.

Other objects and advantages of the present invention will be apparent from the following description and the accompanying drawings.

DETAILED DESCRIPTION

Figure 1:
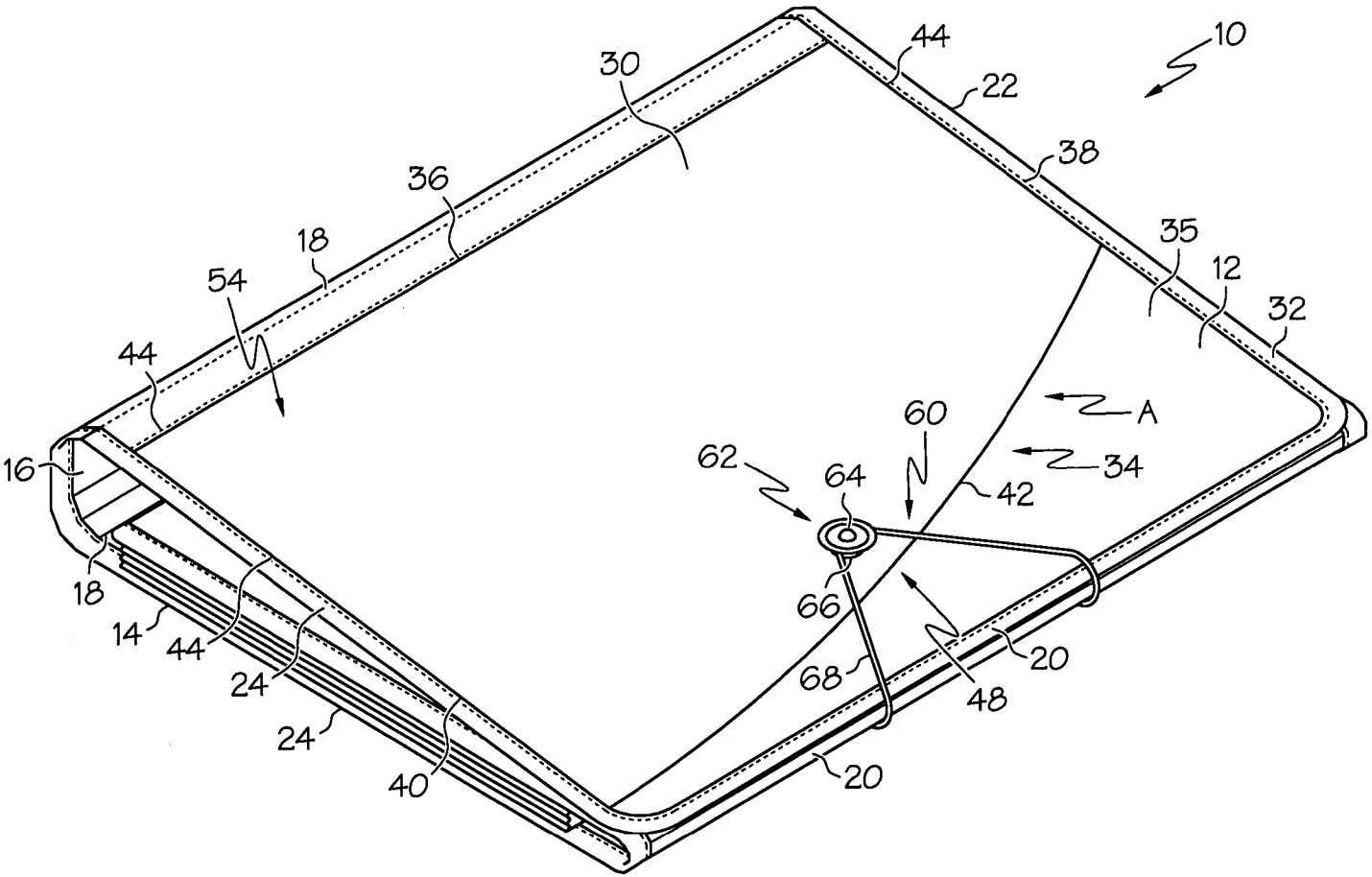
FIG. 1 is a front perspective view of one embodiment of the binder of the present invention, shown in its closed position.
Figure 2:
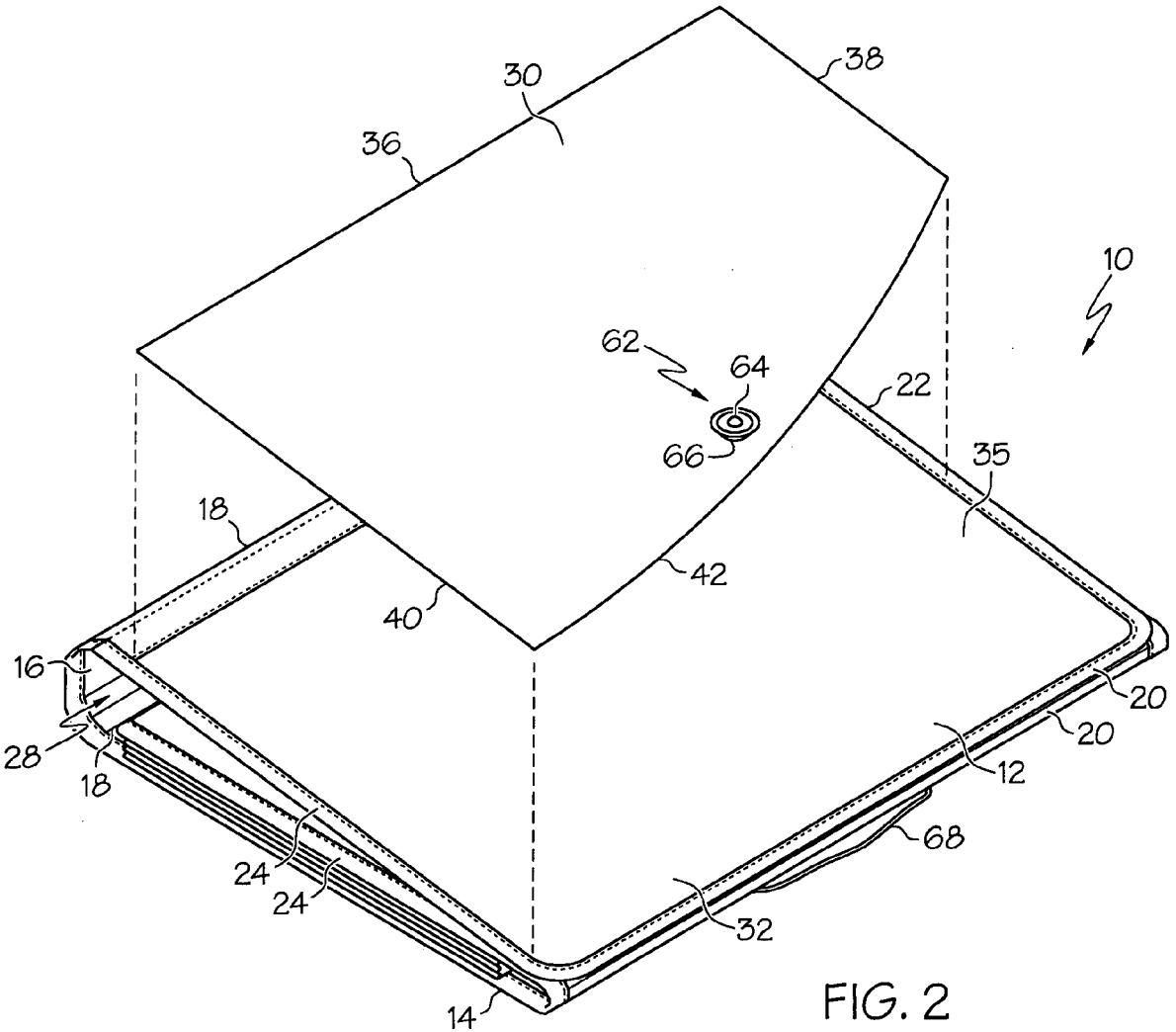
FIG. 2 is a front perspective view of the binder of FIG. 1, with the front panel exploded from the body of the binder.

As shown in FIG. 1, the binder of the present invention, generally designated 10, may include a front cover 12 and rear cover 14, each of which may be pivotally coupled to a spine or spine portion 16. Each of the front cover 12, rear cover 14 and spine 16 may be generally planar, generally rectangular and generally rigid (i.e., sufficiently rigid to support a stack of school materials, such as books and the like, without significant bending or deformation). Each of the front 12 and rear 14 covers may include a rear edge 18, front edge 20, top edge 22 and bottom edge 24. Each of the rear edges 18 of the covers 12, 14 may be pivotally coupled to the spine 16, and the front edges 20 may be located generally opposite the associated rear edge 18 or spine 16. Each of the top 22 and bottom 24 edges may extend between the associated front 20 and rear 18 edges.

Figure 4:
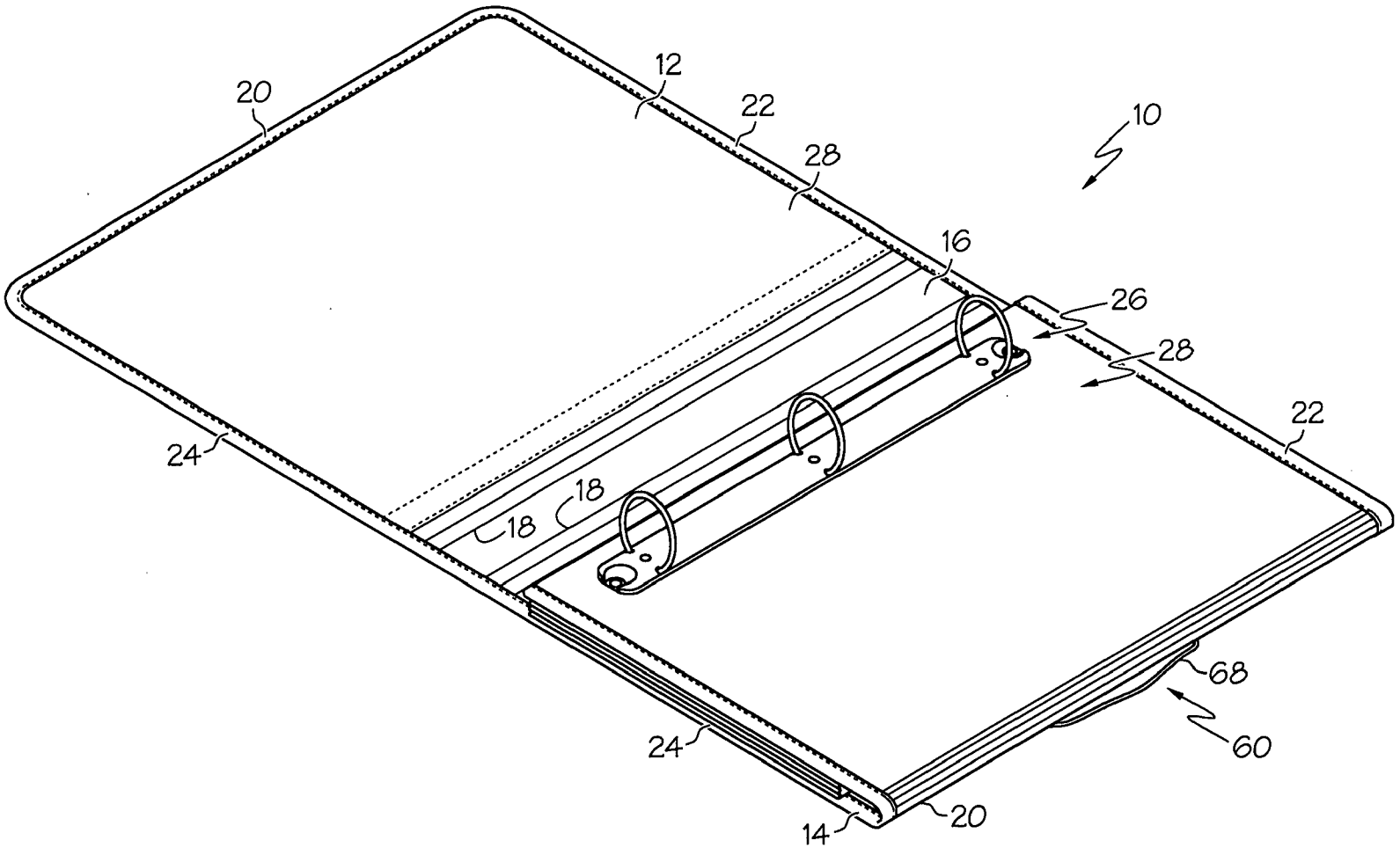
FIG. 4 is a front perspective view of the binder of FIG. 1, with the binder in its open position.

The binder 10 may be movable between a closed position, wherein the front 12 and rear 14 covers are generally parallel and facing each other (FIG. 1), and an open position wherein the front 12 and rear 14 covers are not generally parallel and facing each other (FIG. 4). As shown in FIG. 4, the binder may include a binding mechanism 26, such as a three-ring binder or the like located on an inner surface 28 thereof (i.e., on an inner surface of either of the covers 12, 14 or the spine 16).

As shown in FIG. 1, the binder 10 may include a panel 30 located on an outer surface of the binder body 32 to thereby form a pocket 34 between the panel 30 and the binder body 32. The panel 30 may include a rear edge 36, top edge 38, and bottom edge 40 extending generally parallel to, and located adjacent to the rear edge 18, top edge 22 and bottom edges 24 of the associated cover (i.e., in this case, the front cover 12). The panel 30 may also include a free edge 42 which is generally not directly coupled, or at least partially not directly coupled, to the outer surface 35 of the binder body 32. Each of the rear edge 36, top edge 38 and bottom edges 40 of the panel 30 may be directly coupled to the outer surface 35 of the binder body 32, such as, for example, by stitching 44 which extends through both the panel 30 and the front cover 12.

In this manner, the panel 30 and outer surface 35 of the binder body 32 may cooperate to form a pocket 34 therebetween, with the pocket 34 including a mouth 48. The mouth 48 may be at least partially defined by the free edge 42 such that the free edge 42 extends generally parallel to the mouth 48 of the pocket 34. Thus, in the illustrated embodiment, the mouth 48 may be located adjacent to the front edge 20 of the front cover 12.

The free edge 42 of the panel 30 may be located a variable distance from an outer edge of the binder body 32 along the length of the free edge 42 such that the pocket 34 has a variable width. For example, in the illustrated embodiment, the free edge 42 of the panel 30 is located a variable distance from the front edge 20 of the binder 10. In the illustrated embodiment, the free edge 42 is generally curved relative to the front edge 20 of the front cover 12. The free edge 42 may be somewhat or generally parallel to either of the front 20 or rear 18 edges, and/or may be a variable distance from the front 20 or rear 18 edges. Further alternately, the free edge 42 may extend in a generally non-perpendicular or non-parallel manner from any of the outer edges of the front cover 12 or binder body 32.

Figure 3:
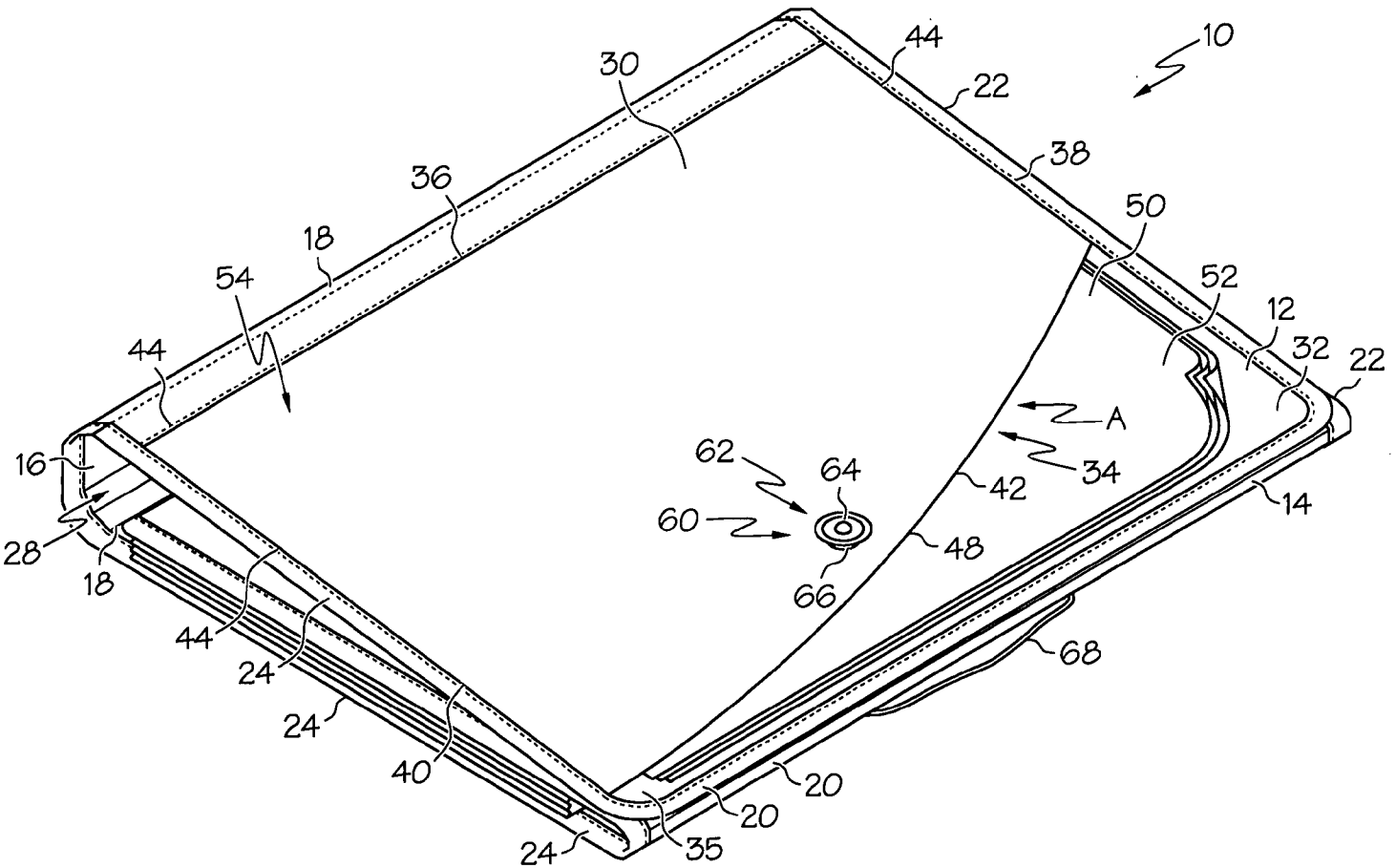
FIG. 3 is a front perspective view of the binder of FIG. 1, with a paper inserted into the front pocket and the closure mechanism being located in its release position.

In this manner, the free edge 42 of the panel 30 provides a variable width pocket. For example, as shown in FIG. 3, when papers 50 are inserted into the pocket 34, the papers 50 can be generally fully received in the pocket 34, but upper portion 52 of the papers 50 may be revealed or exposed or not received by the pocket 34 so that a user can ascertain that the pocket 34 includes papers or other components stored therein. Furthermore, the variable width pocket 34 enables a user easier access to the contents of the pocket 34. For example, relatively small items (i.e., index cards, coins, etc.) may be stored in the lower left hand corner 54 of the pocket 34. When a user desires to access the smaller contents stored in the corner 54 of the pocket 34, the user can reach into the pocket via location A located adjacent to the upper right corner thereof to provide easier access to the contents, due to the fact that the free edge 42 of location A can flex away from the binder body 32.

Of course, the pocket 34 can be formed by a panel 30 having different shapes and/or sizes than those disclosed herein. For example, the panel 30 need not be rectangular, need not have the same size or shape as the associated cover 12, can have a differently shaped free edge 42 than that disclosed herein, etc.

The binder 10 may include a closure mechanism 60 which can maintain the binder in its closed position. As shown in FIG. 1, in one embodiment the closure mechanism 60 may include an anchor component 62, such as a rivet having a stem 66 and a top cap 64 in a generally "mushroom" shape, coupled to the panel 30. The closure mechanism 60 may further include a loop or strap of expandable or elastic material 68 fixedly coupled to the rear cover 14. In order to maintain the binder 10 in its closed position, the loop of elastic material 68 can be stretched and looped around the anchor component 62 as shown in FIG. 1 such that the closure mechanism 60 is in its engaged position. The loop of elastic material 68 may also help to maintain the pocket 34 in a compressed or "closed" position to retain loose items therein.

In order to move the binder 10 to its open position, the closure mechanism 60 is moved to its release position by stretching the elastic cord 68 and lifting the cord 68 around and over the anchor component 62, as shown in FIG. 3. The binder 10 can then be moved to its open position, as shown in FIG. 4. Of course, the components of the closure mechanism 60 may be reversed such that the elastic component 68 is located on the panel 30 or front cover 12, and the anchor component 62 is located on the rear cover 14. Furthermore, the anchor 62 can be located directly on the front cover 12. Additionally, a wide variety of closure mechanisms can be used, including zippers, snaps, clasps, hooks, brackets, interengaging geometries, hook and loop fasteners, etc.

Having described the invention in detail and by reference to the preferred embodiments, it will be apparent that modifications and variations thereof are possible without departing from the scope of the invention.

What is claimed is:

1. A binder comprising:

a binder body including a front cover and a rear cover directly or indirectly pivotally coupled together, said binder body including an inner surface and an outer surface generally opposite said inner surface; and a panel located on said outer surface of said binder body to thereby form a pocket between said panel and said binder body and wherein said pocket is located on said outer surface, said panel having a free edge located adjacent to a mouth of said pocket, said mouth facing an outer edge of said binder body, said free edge of said panel being located a variable distance from said outer edge of said binder body along a length of said free edge such that said pocket has a variable width wherein each of said front and rear covers are generally rectangular and have a rear edge, front edge, top edge and bottom edge, said front and rear covers being directly or indirectly coupled along said rear edges, said front edge of each cover being located generally opposite said rear edge, said top and bottom edges extending between the associated front and rear edges and wherein said mouth is located adjacent to said front edge of at least one of said front or rear covers, wherein said binder is movable between a closed position, wherein said front and rear covers are generally parallel and facing each other, and an open position wherein said front and rear covers are not generally parallel and facing each other, and wherein said binder further includes a closure mechanism for retaining said binder in said closed position, at least part of said closure mechanism being located on said panel, wherein said closure mechanism includes an anchor component fixedly coupled to said panel or one of said covers, and an elastic component shaped to fit around said anchor component, said elastic component being fixedly coupled to the other one of said panel and said one of said covers.

2. The binder of claim 1 wherein said free edge is generally curved relative to said outer edge.

3. The binder of claim 1 wherein said free edge extends generally parallel to said mouth of said pocket.

4. The binder of claim 1 wherein said binder body includes a spine portion located between said front and rear covers, and wherein each of said front and rear covers are pivotally coupled to said spine portion.

5. The binder of claim 1 wherein said panel is coupled to one of said front or rear covers at least partially along or adjacent to each of said rear, top and bottom edges of said one of said front or rear covers.

6. The binder of claim 1 wherein said panel includes a rear edge, a top edge and a bottom edge extending generally parallel to said rear edge, said top edge and said bottom edge of said cover, respectively, and wherein said free edge extends between said top and bottom edges of said panel.

7. The binder of claim 1 wherein said panel is located on and faces one of said front and rear covers, and wherein said free edge is curved relative to said front edge of said one of said covers.

8. The binder of claim 1 further comprising a binding mechanism located on said inner surface of said binder body.

9. The binder of claim 1 wherein said free edge is at least partially not directly coupled to said binder body.

10. The binder of claim 1 wherein said free edge is generally not directly coupled to said binder body.

11. The binder of claim 1 wherein said binder includes a plurality of outer edges extending around the outer periphery of said binder body in top view, and wherein at least part of said free edge extends in a generally non-parallel and non-perpendicular direction relative to any outer edges of said binder.

12. The binder of claim 11 wherein the majority of said free edge extends in said generally non-parallel and non-perpendicular manner.

13. The binder of claim 11 wherein said free edge is generally curved relative to any of said outer edges of said binder.

14. The binder of claim 1 wherein said panel includes a plurality of edges including said free edge, and wherein each edge other than said free edge is directly coupled to said binder body.

15. A binder comprising:

a binder body including a front cover and a rear cover directly or indirectly pivotally coupled together, said binder body being movable between a closed position, wherein said front and rear covers are generally parallel and facing each other, and an open position wherein said front and rear covers are not generally parallel and facing each other;

a panel located on an outer surface of one of said front or rear covers to thereby form a pocket between said panel and said one of said front or rear covers; and a closure mechanism for retaining said binder in said closed position, a first part of said closure mechanism being located on said panel and a second part of said closure mechanism being located on the other one of said front or rear covers, wherein said first and second parts of said closure mechanism cooperate to retain said binder in said closed position wherein said closure mechanism includes an anchor component fixedly coupled to said panel or said other one of said covers, and an elastic component shaped to fit around said anchor component, said elastic component being fixedly coupled to the other one of said panel or said other one of said covers wherein said panel has a free edge located adjacent to a mouth of said pocket, said free edge of said panel being located a variable distance from an outer edge of said binder body along a length of said free edge such that said pocket has a variable width.

16. The binder of claim 15 wherein said panel is coupled to said front cover, said anchor component is coupled to said panel, and said elastic component is coupled to said rear cover.

17. The binder of claim 15 wherein said free edge is generally curved relative to said outer edge.

18. The binder of claim 15 wherein said free edge extends generally parallel to said mouth of said pocket.

19. The binder of claim 15 wherein said binder body includes a spine portion located between said front and rear covers, and wherein each of said front and rear covers are pivotally coupled to said spine portion.

20. The binder of claim 15 wherein each of said front and rear covers are generally rectangular and have a rear edge, front edge, top edge and bottom edge, said front and rear covers being directly or indirectly coupled along said rear edges, said front edge of each cover being located generally opposite said rear edge, and said top and bottom edges extending between the associated front and rear edges.

21. A binder comprising:

a binder body including a front cover and a rear cover directly or indirectly pivotally coupled together, said binder body being movable between a closed position, wherein said front and rear covers are generally parallel and facing each other, and an open position wherein said front and rear covers are not generally parallel and facing each other;

a panel located on an outer surface of one of said front or rear covers to thereby form a pocket between said panel and said one of said front or rear covers; and a closure mechanism for retaining said binder in said closed position, a first part of said closure mechanism being located on said panel and a second part of said closure mechanism being located on the other one of said front or rear covers, wherein said first and second parts of said closure mechanism cooperate to retain said binder in said closed position wherein said closure mechanism includes an anchor component fixedly coupled to said panel or said other one of said covers, and an elastic component shaped to fit around said anchor component, said elastic component being fixedly coupled to the other one of said panel or said other one of said covers, wherein each of said front and rear covers are generally rectangular and have a rear edge, front edge, top edge and bottom edge, said front and rear covers being directly or indirectly coupled along said rear edges, said front edge of each cover being located generally opposite said rear edge, and said top and bottom edges extending between the associated front and rear edges wherein said panel is coupled to one of said front or rear covers at least partially along or adjacent to each of said rear, top and bottom edges of said one of said front or rear covers.

22. The binder of claim 21 wherein said panel includes a rear edge, a top edge and a bottom edge extending generally parallel to said rear edge, said top edge and said bottom edge of said cover, respectively, and wherein said free edge extends between said top and bottom edges of said panel.

23. The binder of claim 21 wherein said panel is located on and faces one of said front and rear covers, and wherein said free edge is curved relative to said front edge of said one of said covers.

24. The binder of claim 15 further comprising stitching coupling said panel to said binder body.

25. The binder of claim 15 further comprising stitching and wherein said panel is coupled to one of said front or rear covers by said stitching that extends through said panel and at least partially through said one of said front or rear covers.

26. The binder of claim 15 further comprising a binding mechanism located on an inner surface of said binder body.

27. The binder of claim 15 wherein said front and rear covers are pivotally coupled along a rear edge of each of said front and rear covers, and wherein said free edge is located generally opposite of said rear edges.

28. A binder comprising:

a binder body including a front cover and a rear cover directly or indirectly pivotally coupled together, said binder body being movable between a closed position, wherein said front and rear covers are generally parallel and facing each other, and an open position wherein said front and rear covers are not generally parallel and facing each other;

a panel located on an outer surface of one of said front or rear covers to thereby form a pocket between said panel and said one of said front or rear covers; and a closure mechanism for retaining said binder in said closed position, a first part of said closure mechanism being located on said panel and a second part of said closure mechanism being located on the other one of said front or rear covers, wherein said first and second parts of said closure mechanism cooperate to retain said binder in said closed position wherein said closure mechanism includes an anchor component fixedly coupled to said panel or said other one of said covers, and an elastic component shaped to fit around said anchor component, said elastic component being fixedly coupled to the other one of said panel or said other one of said covers wherein said panel includes a plurality of edges including said free edge, and wherein each edge other than said free edge is directly coupled to said binder body.

29. The binder of claim 1 further comprising stitching coupling said panel to said binder body, and wherein said panel is coupled to one of said front or rear covers by said stitching that extends through said panel and at least partially through said one of said front or rear covers.

30. The binder of claim 1 wherein said panel has a top edge, rear edge and bottom edge directly coupled to the associated top edge, rear edge, and bottom edge of one of said front or rear covers such that the free edge of said panel is the only edge of said panel that is not directly coupled to said one of said front or rear covers.

* * * * *

UNITED STATES PATENT AND TRADEMARK OFFICE

CERTIFICATE OF CORRECTION

PATENT NO. : 7,252,452 B2
APPLICATION NO. : 10/462190
DATED : August 7, 2007
INVENTOR(S) : Thomas J. Africa et al.

It is certified that error appears in the above-identified patent and that said Letters Patent is hereby corrected as shown below:

Column 6

Line 7 - After the word "Claim", change "21" to -- 20 --.

Line 12 - After the word "Claim", change "21" to -- 20 --.

Signed and Sealed this

Sixth Day of November, 2007

JON W. DUDAS
*Director of the United States Patent and Trademark Office*